United States Patent [19]

Rodger

[11] Patent Number: 4,460,005

[45] Date of Patent: Jul. 17, 1984

[54] WASHING APPARATUS FOR TUBULAR MEMBERS

[75] Inventor: Edward F. Rodger, Houston, Tex.

[73] Assignee: The C. A. Rubio Company, Houston, Tex.

[21] Appl. No.: 250,030

[22] Filed: Apr. 1, 1981

[51] Int. Cl.[3] ..... B08B 9/02

[52] U.S. Cl. ..... 134/104; 134/152; 134/193

[58] Field of Search ..... 134/104, 143, 152–153, 134/159, 193–194, 200, 166 C

[56] References Cited

U.S. PATENT DOCUMENTS

| | | | |
|---|---|---|---|
| 1,034,299 | 7/1912 | Gribben | 134/109 |
| 1,161,621 | 11/1915 | Craven | 134/194 X |
| 1,826,015 | 10/1931 | Morton | 134/104 X |
| 2,250,729 | 7/1941 | Smith et al. | 220/252 |
| 2,395,747 | 2/1946 | Loeb | 134/96 X |
| 2,478,188 | 8/1949 | Gibson | 68/131 X |
| 2,720,771 | 10/1955 | Lewis | 134/111 X |
| 2,746,467 | 5/1956 | Dempsey et al. | 134/111 |
| 2,764,171 | 9/1956 | Nolte | 134/153 X |
| 2,888,307 | 5/1959 | Graves et al. | 312/211 |
| 2,960,991 | 11/1960 | Bland | 134/194 X |
| 2,970,819 | 2/1961 | Kleebauer | 134/194 X |
| 2,990,302 | 6/1961 | Bland | 134/194 X |
| 3,048,277 | 8/1962 | Bland | 134/184 X |
| 3,214,867 | 11/1965 | Henning | 134/152 X |
| 3,233,773 | 2/1966 | Sheppard | 220/334 X |
| 3,592,205 | 7/1971 | Sheppard | 134/107 X |
| 3,703,905 | 11/1972 | Ice, Jr. | 134/153 X |
| 4,196,019 | 4/1980 | Kohler et al. | 134/104 |

FOREIGN PATENT DOCUMENTS

| | | | |
|---|---|---|---|
| 516556 | 1/1940 | United Kingdom | 134/194 |
| 845298 | 8/1960 | United Kingdom | 134/201 |

*Primary Examiner*—Robert L. Bleutge

*Attorney, Agent, or Firm*—Pravel, Gambrell, Hewitt, Kirk & Kimball

[57] ABSTRACT

A new and improved apparatus for washing soiled tubular members in a cleaning fluid wherein the apparatus includes a cleaning fluid tank for containing the cleaning fluid therein, support members with the cleaning fluid tank for supporting the tubular member between positions in and out of the cleaning fluid tank, along with directing means for directing cleaning fluid against the soiled tubular member and collection members with the cleaning fluid tank for collecting sludge formed during the washing of the tubular member.

18 Claims, 10 Drawing Figures

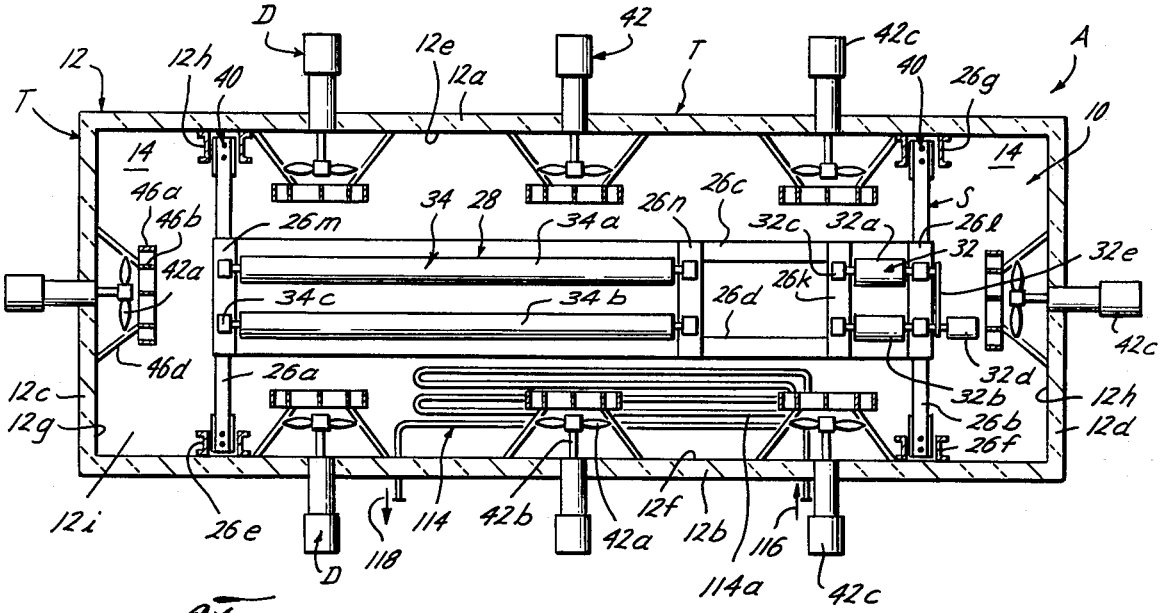
Fig. 5
Fig. 6
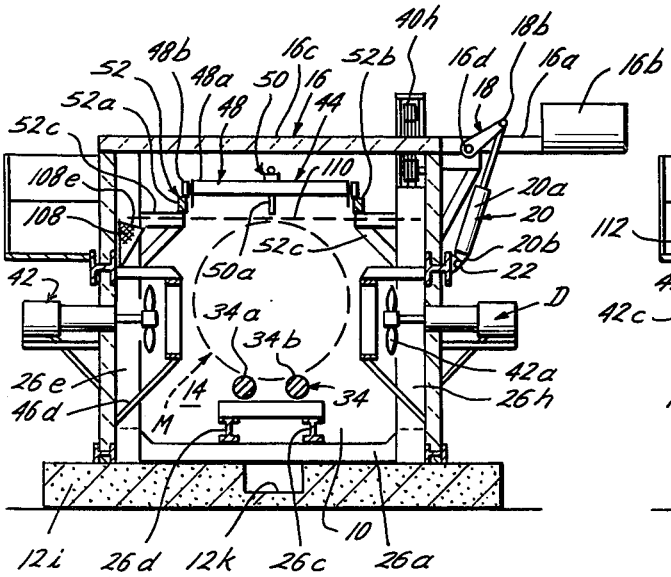
Fig. 7
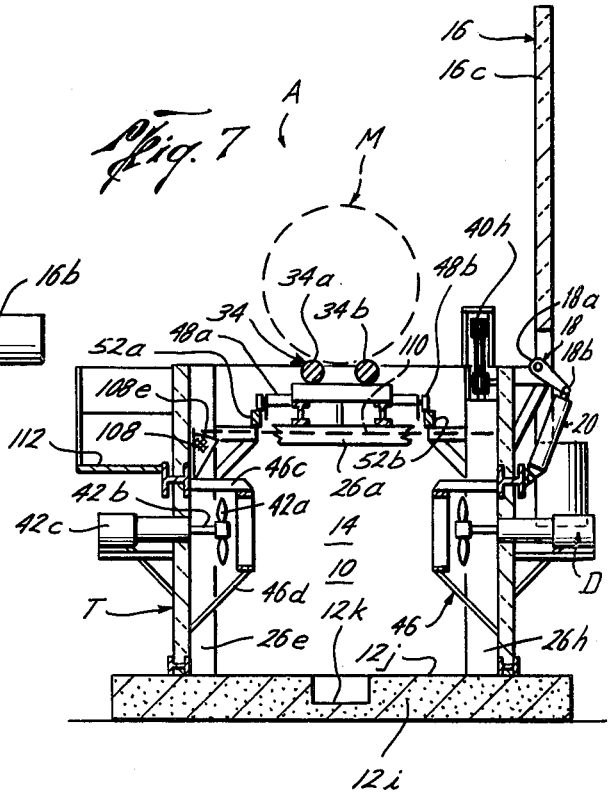

WASHING APPARATUS FOR TUBULAR MEMBERS

TECHNICAL FIELD

The field of this invention relates to methods and apparatus adapted to be used for washing soiled articles, particularly of the type that are adapted to wash large, elongate soiled tubular members in a cleaning fluid.

PRIOR ART

Washing devices of many types have long been known in the prior art and have included many types of cleaning devices, such as those used for cleaning dishes and the like, shown by way of example in U.S. Pat. Nos. 1,034,229; 1,161,621; 2,970,819; and 2,395,747. Other types of cleansing devices have included those such as shown in U.S. Pat. No. 2,478,188, for a washing machine for fabrics and in U.S. Pat. No. 1,826,015 for a fruit washer having a removable filter tray. Great Britain Pat. No. 516,556 discloses an apparatus for washing dishes wherein a propellor and heater are mounted within a chamber, with the propellor directing fluid against article to be cleaned. However, as the need increased for various other types of washing devices capable of cleaning metallic types of articles, other types of mechanisms were developed, as for example, the metal cleaning apparatus of U.S. Pat. No. 2,746,467.

Multiple attempts have been made at increasing cleaning action within the various cleaning vessels by suitable agitation of the cleaning fluid within the vessel. These have included particular types of liquid structures such as disclosed in U.S. Pat. No. 2,720,711 wherein propellor action is used to draw cleaning fluid through a cleaning fluid filter and agitate the same. However, the utilization of propellors or fluid pumps of various types in a cleaning tank is known in the prior art. Circulating systems such as disclosed in U.S. Pat. No. 3,233,773 attempt to increase cleaning fluid circulation about the member that is to be cleaned by the cleaning device. While different types of mechanisms for agitating cleansing fluids are disclosed by U.S. Pat. Nos. 2,960,991; 2,990,302; and 3,048,277, these references incorporate various baffling techniques to enhance agitation of the cleaning fluid within the tank to promote cleansing action, by suitably directing the cleaning fluid against the soiled article to be cleaned. Further, various types of mechanisms have been used for opening and closing the closures and tops for such article cleaning devices such as disclosed in U.S. Pat. Nos. 2,250,729; 2,888,307 and Great Britain Pat. No. 845,298, all of which disclose multiple types of hinge-top closure arrangements.

U.S. Pat. No. 3,592,205 discloses a washing apparatus having a filter for separating sludge that is a resultant by-product of the cleaning of the soiled product. This patent incorporates utilization of a large volume cleaning tank for receiving such soiled parts and has a propellor in the tank for flowing the cleaning fluid against the soiled part submerged therein, with a small volume sludge trap in combination therewith for receiving and removing sludge from the cleaning fluid during cleaning operations.

However, so far is known, no method or apparatus is available capable of easily handling large soiled tubular members with such devices capable of moving such members to and from a cleaning position within the tank and further having suitable fluid agitation provisions to insure proper cleaning thereof, as well as an easily maintainable filtering arrangement adapted to trap sludge wastes for removal from the tank without necessitating a complete operational shutdown of the cleaning apparatus during filtering and/or cleaning of the cleaning fluid itself. Furthermore, so far is know, no suitable device is capable of receiving such a soiled tubular member and rotating the tubular member about the tubular member's longitudinal axis for cleaning of the outside surface thereof while further enhancing utilization of high-pressure cleaning fluid directed from nozzles for blasting soil from the tubular member while permitting 360° rotation of the tubular member within the tank to insure thorough cleaning thereof.

SUMMARY OF THE INVENTION

The present invention relates to a new and improved washing apparatus and method for washing a soiled tubular member in a cleaning fluid, wherein the apparatus includes a cleaning fluid tank for containing the cleaning fluid therein, a suitable support mechanism with the cleaning fluid tank for supporting the tubular member between positions wherein the tubular member is either out of or within the cleaning fluid tank, with the cleaning fluid tank having suitable directing members therewith for directing cleaning fluid against the soiled tubular member when the tubular member is within the tank, and further having collection members with the cleaning fluid tank for collecting the sludge formed during washing of the tubular member.

BRIEF DESCRIPTION OF THE DRAWINGS

FIG. 5 is a sectional, plan view of the washing apparatus of the present invention taken along the lines 5—5 of FIG. 3;

FIG. 6 is an elevational, sectional side view of the washing apparatus of the present invention taken along the lines 6—6 of FIG. 3, with the tubular member disposed within the cleaning fluid tank in a position to be washed;

FIG. 7 is an elevational, sectional side view of the washing apparatus of the present invention, similar to FIG. 6, showing the tubular member in a position outside of the cleaning fluid tank and with the tank closure in a fully open position;

DESCRIPTION OF THE PREFERRED EMBODIMENT

Figure 1:
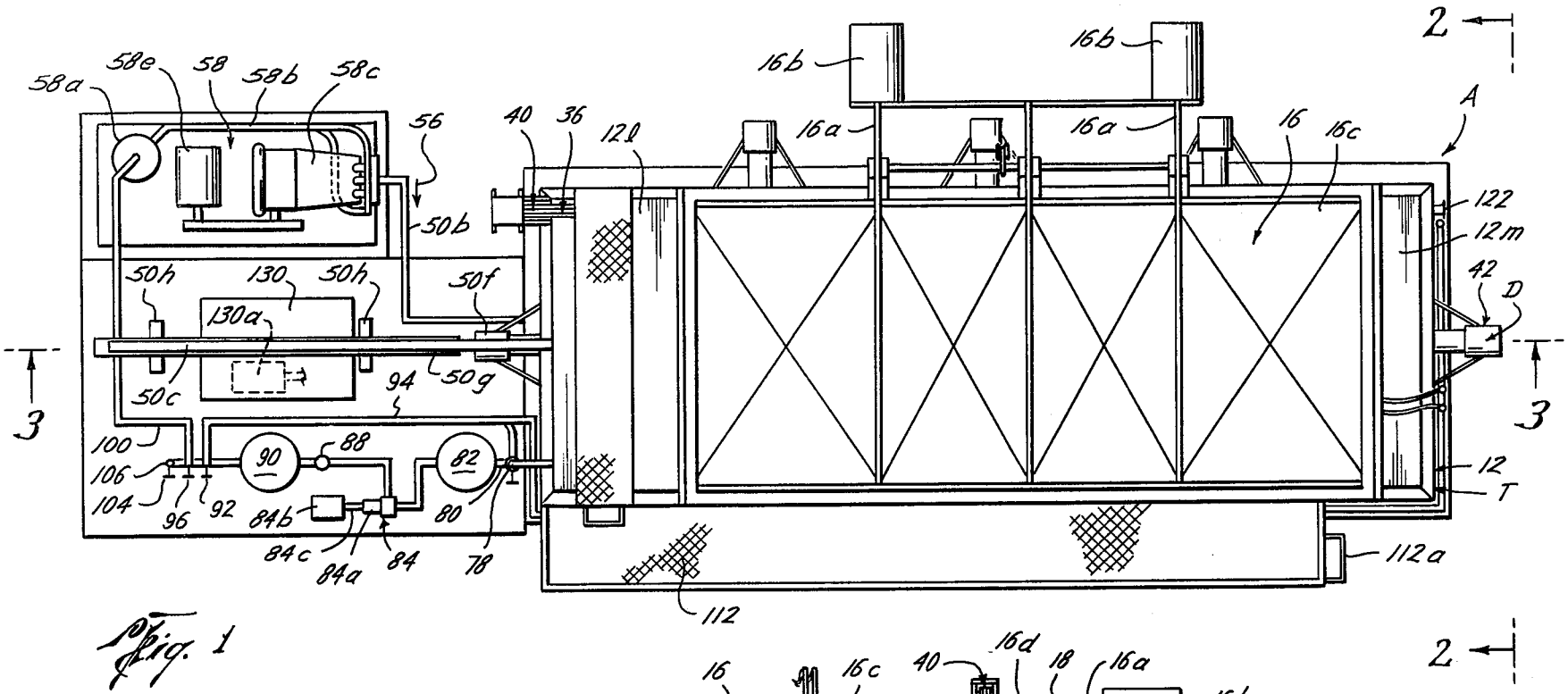
FIG. 1 is a plan view of the washing apparatus of the present invention.

Referring to the drawings, the washing apparatus of the present invention is designated generally by the letter A. The washing apparatus A is adapted to be used for washing a soiled tubular member M in a cleaning fluid 10, with the cleaning fluid and the soil capable of combining and forming sludge. The washing apparatus A includes generally a cleaning fluid tank T, support means S for supporting the tubular member M, directing means D for directing the cleaning fluid 10 against the soiled tubular member M and collection means C with the cleaning fluid tank T for collecting sludge formed during washing of the soiled tubular member M. Unless otherwise specified, it is preferred that the component parts of the washing apparatus A of the present invention be made of suitable non-corrosive, high strength materials capable of taking the stresses and strains associated with the hydraulic pressures due to fluids, as well as overall loads incumbent with raising the lowering of the tubular member M during utilization of the washing apparatus A of the present invention.

The washing apparatus A of the present invention is adapted to be used for washing a soiled tubular member M as best seen in FIGS. 6 and 7. The tubular member M may be of any circular cross-section and may include any type of cylindrical member or bundle having a plurality of tubes disposed therein, such as the type used in catalytic reactors having catalyst tubes for receiving suitable catalysts therein, heat exchangers and the like. In most instances, such tubular members M are of significant size, with the diameters of such being up to six feet in diameter and lengths up to 24 feet long, and thus are of substantial weight and dimension. The tubular members M may be soiled by dirt, spent catalyst, or any other types of material. It is that soil that is desired to be removed from the tubular member M during washing operations thereof with the washing apparatus A of the present invention. The cleaning fluid 10 may be of any suitable type which may include water or any suitable solvent for removing particular types of dirt, tars, catalysts or the like from the soiled tubular member M that is to be cleaned.

The washing apparatus A of the present invention includes a cleaning fluid tank T for containing the cleaning fluid 10 therein. The cleaning fluid tank T includes a tank 12 having sidewalls 12*a*, 12*b* and end walls 12*c*, 12*d* (FIG. 5). The sidewalls 12*a*, 12*b* have interior wall surfaces 12*e*, 12*f*, respectively and end walls 12*c*, 12*d* have inerior wall surfaces 12*g*, 12*h*, respectively. Preferably, the walls 12*a*, 12*b*, 12*c*, 12*d* are made out of a suitable steel, be it stainless or otherwise, and is capable of withstanding corrosive effects of the cleaning fluid 10 as well as the hydraulic forces acting thereupon due to the cleaning fluid 10 within the cleaning fluid tank T. The tank 12 is formed having a base 12*i* (FIG. 7) that is formed of a suitable concrete or the like, with the base 12*i* having an interior surface 12*j* with a suitable trough 12*k* formed in the central portion of the interior surface 12*j*. The base 12*i* is adapted to be positioned in a suitable location for proper location of the cleaning fluid tank T of the present invention. As such, the interior wall surfaces 12*e*, 12*f*, 12*g*, 12*h* and interior surface 12*j* form a cleaning fluid chamber 14 that is adapted to receive cleaning fluid 10 therein. Furthermore, it will be appreciated that the trough 12*k* formed within the base 12*i* provides a sludge trap for heavy sludge with the trough 12*k* adapted to be in fluid communication with suitable outlet 24 (FIG. 3) for suitable draining thereof when necessary.

The cleaning fluid tank T further includes a tank closure 16 adapted to be pivotally mounted with the cleaning fluid tank T for covering the same. Preferably, the tank 12 includes top tank closure 121 (FIGS. 1, 3) mounted with tank 12 adjacent end wall 12*d*, extending between the uppermost portions of side walls 12*a*, 12*b* while a top tank closure 12*m* is mounted adjacent end wall 12*c*, extending between the uppermost portion of side walls 12*a*, 12*b*. The tank closure 16 is preferably of a size such that it is adapted to engage the uppermost portions of walls 12*a*, 12*b* and top tank closures 12*l*, 12*m* for completely enclosing the upper end of the tank 12 when in a fully closed position as shown in FIG. 6. The tank closure 16 is formed preferably having suitable support arms 16*a* (FIG. 1, 6) for supporting a suitable counterweight 16*b* of suitable mass to counteract the overall weight of the tank closure top 16*c*, when the tank closure 16 is pivoted about pivot point 16*d*. Preferably, a suitable pivot arm 18 is affixed to the pivot point 16*d* at end 18*a*. The pivot arm 18 is pivotally affixed with suitable hydraulic power means 20 at end 18*b*. The hydraulic power means 20 includes a suitable hydraulic piston 20*a* which in turn is pivotally affixed at lower end 20*b* by pin 22 with the cleaning fluid tank T. As best seen in FIGS. 6 and 7, tank closure 16 is movable between a closed position as best seen in FIG. 6 and an open position as best seen in FIG. 7, by hydraulic action of the hydraulic power means 20. The counterweight 16*b* helps to compensate for the overall weight of the top 16*c* and balance the same with respect to the pivot point 16*d*, thus reducing the loading upon hydraulic power means 20 as such is activated to open and/or close the tank closure 16. Thus, the tank closure 16 utilizes the counterweight 16*b* for counteracting the weight of the top 16*c* to facilitate the ease of opening and closing of the tank closure 16 during operations of the washing apparatus A of the present invention.

The washing apparatus A of the present invention further includes support means S with the cleaning fluid tank T for supporting the tubular member M between a first position (FIG. 7) where the tubular member M is not within the cleaning fluid tank T and a second position (FIG. 6) wherein the tubular member M is disposed substantially within the cleaning fluid 10 in the cleaning fluid chamber 14 within the cleaning fluid tank T. The support means includes generally a frame member 26, roller means 28, and moving means 30. The frame member 26 is adapted to receive the tubular member M for movement thereof between the first and second positions of FIG. 7 and FIG. 6, respectively.

Figure 4:
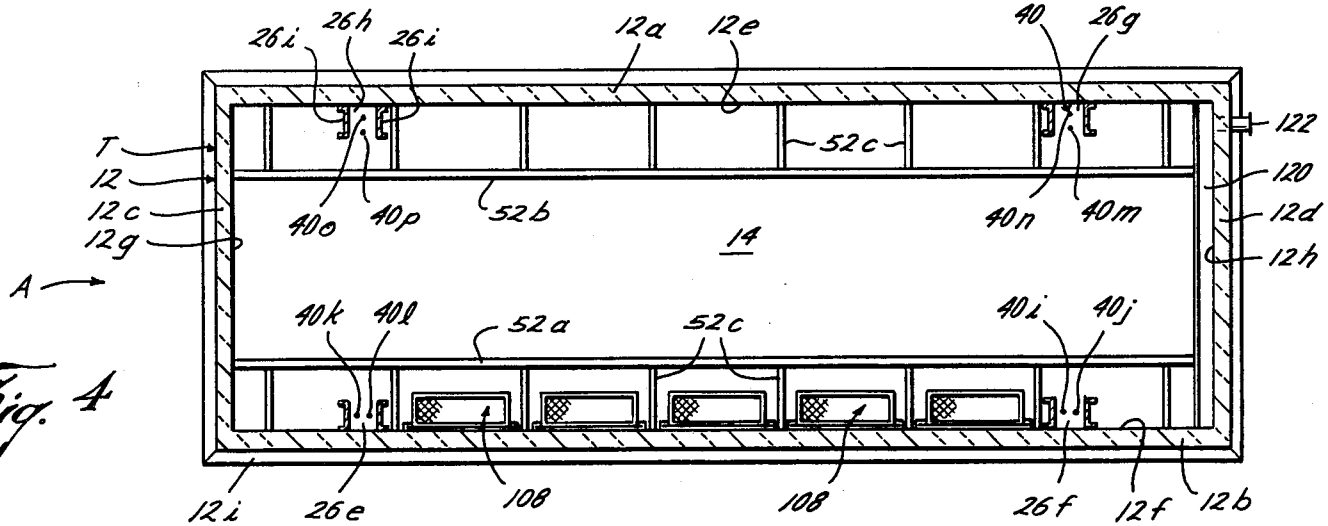
FIG. 4 is a sectional, plan view of washing apparatus of the present invention, taken along the lines 4—4 of FIG. 3.
Figure 8:
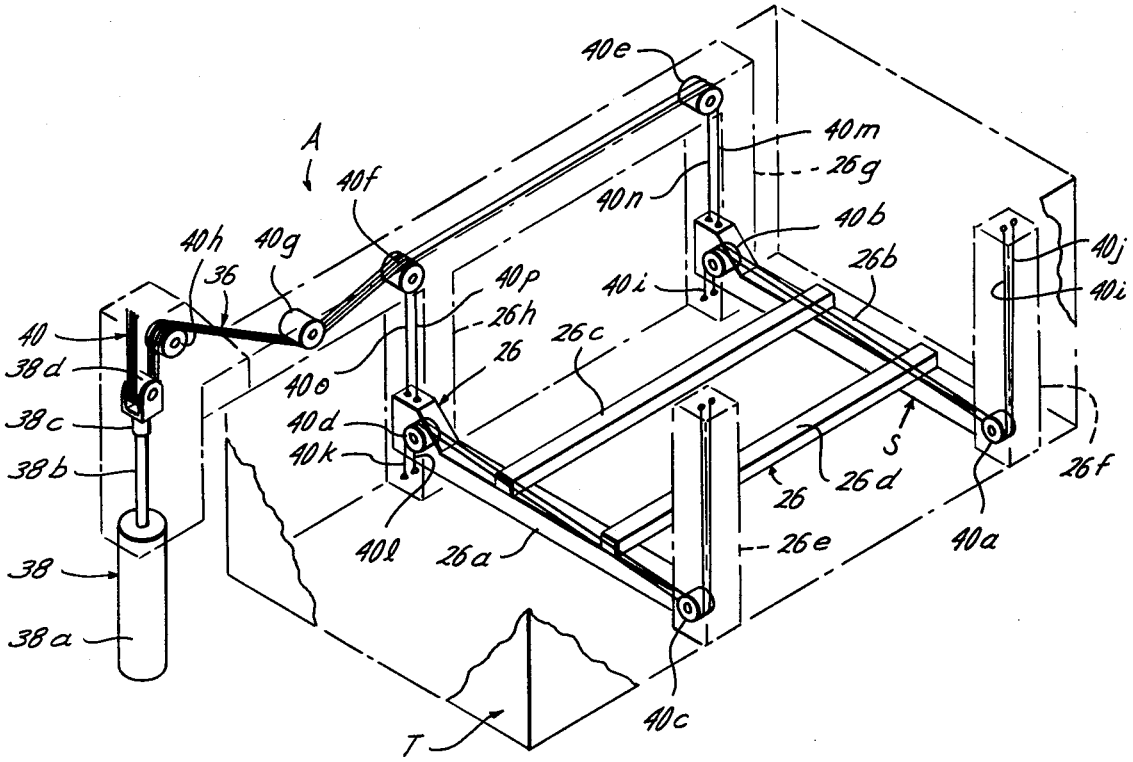
FIG. 8 is a schematic, perspective view of the support means of the washing apparatus of the present invention as used for supporting the tubular member.

As schematically shown in FIG. 8, the frame member 26 preferably includes at least two lateral support members 26*a*, 26*b* and at least two longitudinal support members 26*c*, 26*d*. Preferably, the lateral support members 26*a*, 26*b* are joined by the longitudinal support members 26*c*, 26*d*. As such, the lateral and longitudinal support members 26*a*, 26*b*, 26*c*, 26*d* are adapted to move as a unit between the first position of FIG. 7 and the second position of FIG. 6. The frame member 26 further includes support member guides shown schematically in FIG. 8 as 26*e*, 26*f*, 26*g*, 26*h*. Preferably, each of such support member guides may be formed of opposed vertical members such as 26*i*, 26*j* of support member guide 26*h* as best seen in FIG. 4. As such, lateral support member 26*a* is adapted to extend between support member guides 26*e* and 26*h* while lateral support member 26*b* extends between support member guides 26*f*, 26*g*, with both lateral support members 26*a*, 26*b* adapted to move in a reciprocal, vertical fashion within their respective support member guides 26*e*, 26*f*, 26*g*, 26*h*.

Figure 3:
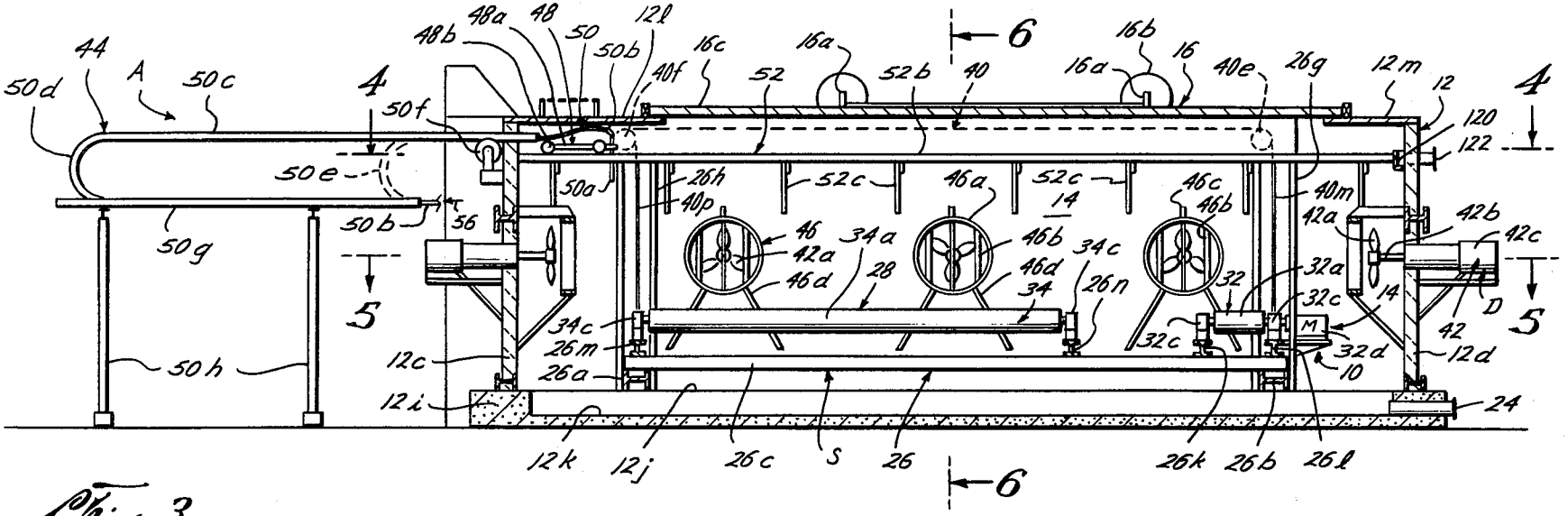
FIG. 3 is an elevational, sectional, side view of the washing apparatus of the present invention, taken along the lines 3—3 of FIG. 1.

The support means S of the washing apparatus A of the present invention further includes roller means designated generally as 28. The roller means 28 is mounted with the frame member 26 for permitting rotation of the tubular member M when supported by the frame member 26. The roller means 28 includes power rollers 32 and idler rollers 34. Preferably, the power rollers 32 include rollers 32*a*, 32*b* that are adapted to be mounted on frame member 26. Preferably, the rollers 32*a*, 32*b* are mounted upon roller supports 26*k*, 26*l* extending between longitudinal support members 26*c*, 26*d* of the frame member 26 (FIGS. 3, 5). Suitable pillow blocks such as 32*c* are utilized for mounting the rollers 32*a*, 32*b* of the power rollers 32 for rotation with respect to the frame member 26. Motor means 32*d* is operatively connected with the power rollers 32*a*, 32*b* by suitable power transmission means 32*e*. The motor means 32*d* may be any suitable type of motor, be it mechanical, electrical, hydraulic or the like; however, as discussed more fully hereinbelow, it is preferred that the motor means 32*d* be hydraulically powered. The power transmission means 32*e* may include a suitable V-belt, chain, gearing, or the like for transferring power from the motor means 32*d* to rollers 32*a*, 32*b*. Although not shown, each of the power rollers 32 may, if desired, be independently powered by suitable power transmission means 32*e*. However, it will be appreciated that both rollers 32*a*, 32*b* of the power rollers 32 are adapted to rotate about their longitudinal axis in the same direction at a coordinated rate of speed therebetween. The power rollers 32 have an axis of rotation that is adapted to be substantially parallel to the longitudinal axis of the tubular member M for powered rotation of the tubular member M when with the support means S as discussed more fully hereinbelow.

The roller means 28 further includes idler rollers 34, which includes rollers 34*a*, 34*b* which are adapted to be mounted substantially parallel to one another and supported by roller supports 26*m*, 26*n* affixed to and extending between longitudinal support members 26*c*, 26*d* (FIGS. 3, 5). Suitable pillow blocks such as 34*c* are adapted to rotatively support rollers 34*a*, 34*b* upon roller supports 26*m*, 26*n* for rotation thereof. It will be appreciated that roller 32*a* is substantially in longitudinal alignment with roller 34*a* and roller 32*b* is substantially in longitudinal alignment with roller 34*b*, with the tubular member M adapted to be disposed upon both power rollers 32 and idler rollers 34 and consequently extending therebetween. As such, the idler rollers 34 have an axis of rotation that is adapted to be substantially parallel with the axis of rotation of the power rollers 32 and the longitudinal axis of the tubular member M. As such, the idler rollers 34 may rotate freely about their respective pillow blocks 34*c*. As best seen in FIGS. 6 and 7, the tubular member M is adapted to be positioned upon the roller means 28 such that the tubular member M engages both the power rollers 32 and idler rollers 34. As such, the tubular member M is supported substantially along most of its length by the power rollers 32 and idler rollers 34, with the power rollers 32 adapted to engage the exterior surface of the tubular member M for powered rotation thereof.

The washing apparatus A of the present invention further includes moving means designated generally as 36 with the cleaning fluid tank T and the frame member 26 for moving the frame member 26 and the tubular member M between the first position of FIG. 7 and the second position of FIG. 6. The moving means 36 is best illustrated in the schematic view of FIG. 8 and includes generally hydraulic power means 38 and pulley means 40. The hydraulic power means 38 is adapted to be mounted with the cleaning fluid tank T for providing hydraulic motive power as discussed more fully hereinbelow. The hydraulic power means 38 preferably includes a hydraulic cylinder 38*a* and a suitable actuating rod 38*b* in operable communication therewith, with the actuating rod 38*b* adapted to reciprocate with respect to the hydraulic cylinder 38*a*. Preferably, a suitable yoke 38*c* is adapted to be affixed adjacent the upper end of the actuating rod 38*b*, for receiving a roller 38*d*, that is mounted for rotation with the yoke 38*c*.

The pulley means 40 of the present invention is adapted to be mounted with the frame member 26 and operatively connected with the hydraulic power means 38 for moving the tubular member M between the first and second position as described hereinabove. The pulley means 40 includes a plurality of pulley rollers, including pulley rollers 40*a*, 40*b* mounted with lateral support member 26*b*, pulley rollers 40*c*, 40*d* mounted with a lateral support member 26*a*, and pulley rollers 40*e*, 40*f*, 40*g*, 40*h* adapted to be mounted with the cleaning fluid tank T, with all such pulley rollers adapted to be mounted for rotation with their respective supporting members. The pulley means 40 further includes pulley cables 40*i*, 40*j* that are adapted to be affixed adjacent the lower end of support member guide 26*g* extend over pulley rollers 40*b*, 40*a*, and then be affixed adjacent the upper end of support member guide 26*f*. In similar fashion, pulley cables 40*k*, 40*l* are adapted to be affixed adjacent the lower portion of support guide member 26*h*, extend over pulley rollers 40*d*, 40*c* and be affixed with the upper end of support member guide 26*e*. Accordingly, any reciprocal movement of the lateral support members 26*a*, 26*b* of the frame member 26 within their respective support member guides results in the tracking of pulley cables 40*i*, 40*j* about pulley rollers 40*b*, 40*a* and pulley cables 40*k*, 40*l* about pulley rollers 40*d*, 40*c*. The pulley means 40 further includes pulley cables 40*m*, 40*n* that are adapted to be affixed with the upper surface of the lateral support member 26*b* adjacent support guide member 26*g*, with the pulley cables 40*m*, 40*n* extending therefrom over pulley rollers 40*e*, 40*f*, 40*g*, 40*h*, about roller 38*d* and thereafter affixed with the cleaning fluid tank T. In similar fashion, pulley cables 40*o*, 40*p* are affixed with the upper surface of the lateral support member 26*a* adjacent support member guide 26*h*, with the pulley cables 40*o*, 40*p* extending upwardly therefrom about pulley rollers 40*f*, 40*g*, 40*h*, about roller 38*d* and thereafter affixed with the cleaning fluid tank T. As shown in FIG. 8, any downward movement of the actuating rod 38*b* with respect to the hydraulic cylinder 38*a* of the hydraulic power means 38 results in tensioning of pulley cables 40*m*, 40*n*, 40*o*, 40*p* resulting in a force tending to pull the lateral support members 26*a*, 26*b* in their respective support member guides 26*h*, 26*g* in an upwardly direction for lifting the same. Simultaneous with such action, the action of pulley cables 40*i*, 40*j* and 40*k*, 40*l* result in transmission of the lifting force to the opposing side of the lateral support members 26*a*, 26*b* in their respective support member guides 26e, 26f to insure that both ends of the lateral support members 26a, 26b correspondingly move upwardly and/or downwardly at the same rate to prevent any binding of the lateral support members 26a, 26b within their respective support member guides during reciprocal action thereof. As a consequence, downward movement of the actuating rod 38b with respect to the hydraulic cylinder 38a results in a raising of the frame member 26 with respect to the cleaning fluid tank T while extension of the actuating rod 38b results in a lowering of the frame member 26 there into the cleaning fluid tank T for movement of the tubular member M into the second position of FIG. 6.

The washing apparatus A of the present invention further includes directing means D with the cleaning fluid tank T for directing cleaning fluid 10 against the soiled tubular member M when the tubular member M is in the second position of FIG. 6 for washing the same. The directing means D further includes agitation means 42 and high pressure fluid means 44. The agitation means 42 preferably is mounted with the cleaning fluid tank T for agitating the cleaning fluid 10 in the cleaning fluid tank T when the tubular member M is in the second position, to enhance washing of the tubular member M. The agitation means 42 includes a plurality of propellors 42a adapted to be mounted about at least a portion of the inside perimeter of the cleaning fluid tank T and adapted to be immersed in the cleaning fluid 10 within the cleaning fluid chamber 14 for agitating the cleaning fluid 10. As best seen in FIGS. 3, 5, 6 and 7, the propellors 42a are adapted to be mounted with the cleaning fluid tank T and are suited for powered rotation by means of power shaft 42b extending from propellor motor 42c. Each of the propellors 42a preferably has its own propellor motor 42c for powered rotation thereof. As shown in FIG. 5, preferably three such propellors 42a are mounted along the side walls 12a, 12b of tank 12 with one propellor 42a mounted with each end wall 12c, 12d of the tank 12 of the cleaning fluid tank T. The propellor 42a may be of any suitable design; however, as pictured, it is preferred that the propellors be of a three-bladed configuration. Preferably, a suitable propellor guard 46 including a circular frame 46a, vertical supports 46b and mounting supports 46c, 46d for mounting the circular frame 46a with the cleaning fluid tank T are mounted in proximity to each propellor 42a. The vertical supports 46b are preferably mounted within the circular frame 46a in such a position that the propellors 42a are adapted to circulate the cleaning fluid 10 therethrough and such that the vertical supports 46b in combination with the circular frames 46a enhance agitation of the cleaning fluid 10 as such is being agitated by the propellors 42a of the agitation means 42. It will be appreciated that the mounting supports 46c, 46d insure that the circular frame 46a is mounted a sufficient distance away from the propellors 42a to act as a guard for such propellors 42a and as in the appropriate support for the vertical supports 46b. It will be appreciated that although eight propellors 42a are shown in FIG. 5, the number of propellors 42a of the agitation means 42 may be increased or decreased as is necessary to effectuate the necessary cleaning purposes for the soiled tubular member M by utilization of the washing apparatus A of the present invention.

The directing means D further includes high pressure fluid means 44 with the cleaning fluid tank T for flowing high pressure cleaning fluid against the soiled tubular member M for enhanced washing thereof. The high pressure fluid means 44 includes carriage means 48, nozzle means 50, a carriage track 52 and carriage drive means 54. The high pressure fluid means 44 is best seen in FIGS. 3 and 6. Preferably, a carriage track 52 including track members 52a, 52b are adapted to be mounted with the cleaning fluid tank T on the inside portion thereof having a plurality of suitable carriage track supports 52c for supporting the track members 52a, 52b. Preferably, such track members 52a, 52b are mounted along the length of the cleaning fluid tank T such that they are adapted to be aligned with the longitudinal axis of the tubular member M when the tubular member M is in the second position. The carriage track 52 is adapted to receive the carriage means 40a thereon. The carriage means 40a has a suitable platform 48a rollably supported by plurality of wheels 48b such that the platform 48a is adapted to be rolled along the carriage track 52. Nozzle means 50 is mounted with the platform 48a of the carriage means 48 for receiving high pressure cleaning fluids to be directed against the tubular member M for washing thereof. The nozzle means 50 preferably includes a high pressure nozzle 50a in fluid communication with a suitable high pressure fluid line 50b. The high pressure fluid line 50b is adapted to be mounted in fluid line support 50c which is adapted to protect the high pressure fluid line 50b from damage during movement of the carriage means 48 along the carriage track 52. As best seen in FIG. 3, the fluid line support 50c is adapted to move from a position 50d when the carriage means 48 is adjacent the end wall 12c to a position 50e shown in dotted lines upon movement of the carriage means 48 to a position adjacent end wall 12d. Roller guide 50f mounted with the end wall 12c provides a rotatable guide for supporting the fluid line support 50c as it moves between positions 50d, 50e to prevent damage to the high pressure fluid line 50b. Further, track guide 50g insures proper positioning of the fluid line support 50c as the carriage means 48 moves along the length of the cleaning fluid tank T. The track guide 50g is supported by suitable guide supports 50h to insure proper positioning thereof.

Figure 10:
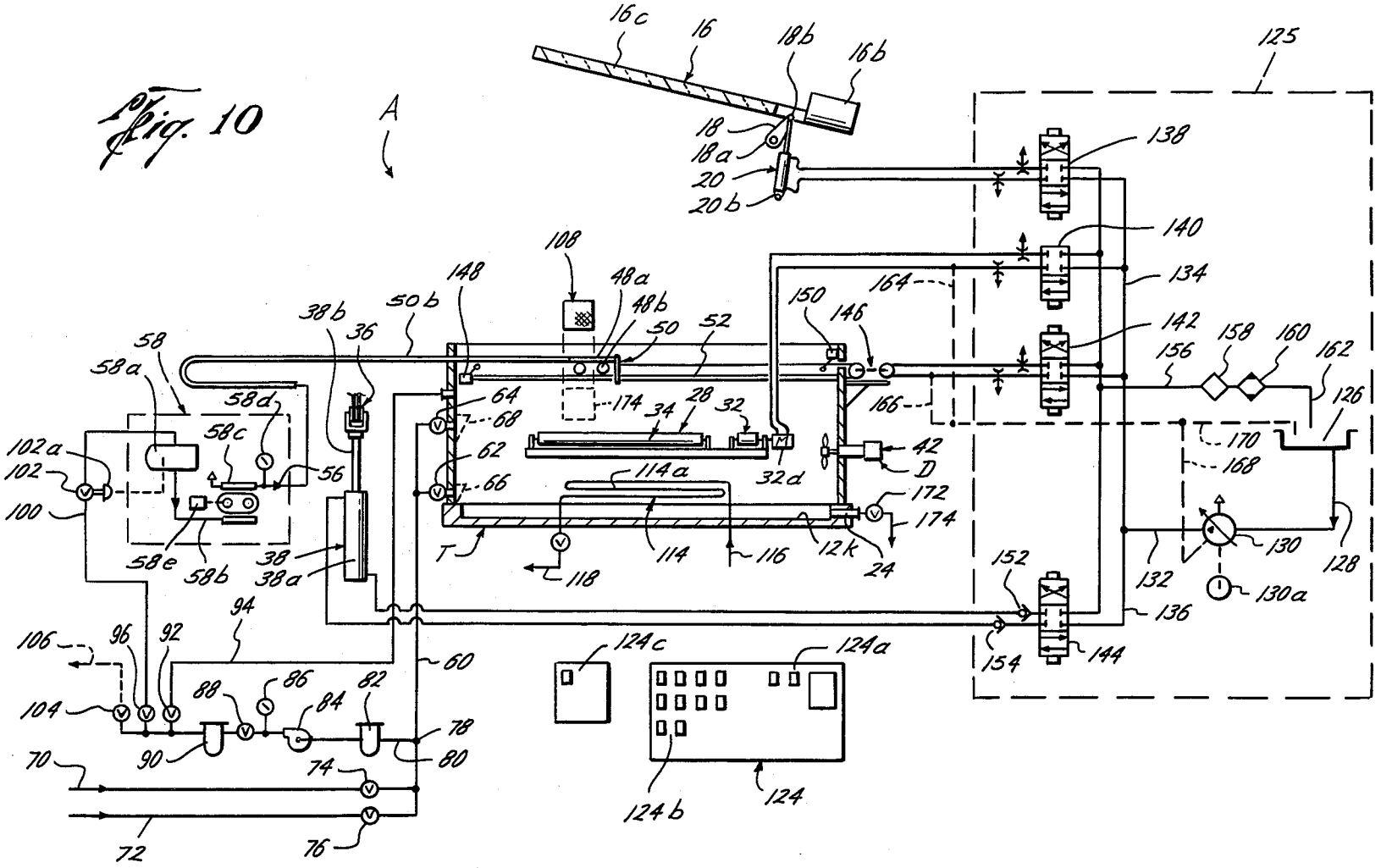

The high pressure fluid line 50b is adapted to receive high pressure fluid flowing in the direction of arrow 56. Fluid flowing in the direction of arrow 56 is received from a high pressure fluid pump designated generally as 58 and shown schematically in FIG. 10. As shown in FIG. 10, fluid is withdrawn from the cleaning fluid tank through fluid line 60 having appropriate inlet valve 62, 64 for regulating fluid into fluid line 60. Inlet screens 66, 68 insure filtered withdrawal of cleaning fluid from the cleaning fluid tank T. In addition, cleaning fluid from storage may flow through flow line 70 while suitable makeup water may flow through flow line 72, pass fluid control valves 74, 76, respectively and mix with the withdrawn fluid in fluid line 60 at point 78. Mixed fluids flow through fluid line 80 through a suitable filter 82 there into a suitable fluid pump 84. The fluid pump 84 includes a pump 84a driven by motor 84b which is operably connected thereto by shaft 84c. A pressure gauge 86 monitors the exit pressure of the fluid from the fluid pump 84. Thereafter, the cleaning fluid 10 flows through control valve 88 and an additional filter 90 to be distributed as is necessary. In the event that additional cleaning fluid is needed within the cleaning fluid tank T, valve 92 is opened to allow flow of cleaning fluid 10 through flow line 94 to return fluid into the cleaning fluid tank T. Furthermore, by opening fluid control valve 96, fluid is allowed to flow through flow line 100 for utilization by the high pressure fluid pump 58.

The high pressure fluid pump 58 includes a surge tank 58*a* in communication with flow line 100. The surge tank 58*a* communicates with fluid pump 58*c* through flow line 58*d*. High pressure fluid exits the fluid pump 58*c* in the direction of arrow 56 to be utilized in high pressure fluid line 50*b* of the nozzle means 50 of the present invention with the exiting fluid pressure sensed by pressure gauge 58*d*. A suitable pressure control valve 102 having a suitable pressure sensor 102*a* permits low pressure shutoff of the fluid pump 58*c* if the surge tank 58*a* experiences low pressure therein. A suitable motor 58*e* of any type powers the fluid pump 58*c*.

It will be appreciated that the carriage means 48 permits movement of the nozzle means 50 along the length of a tubular member M when such is in the second position of FIG. 6, permitting the direction of high pressure cleansing fluid 10 against the exterior surface of the tubular member M. It will be appreciated that the high pressure fluid that may be directed by the nozzle means 50 against the tubular member M may be of the order of magnitude of approximately 6,000 pounds per square inch of pressure at a fluid flow rate of 45 gallons per minute of cleaning fluid 10. Alternatively, the opening of fluid control valve 104 permits circulation of the cleaning fluid 10 through flow line 106 to an appropriate storage chamber whereinafter such may be withdrawn as needed through flow line 70 for reuse as described hereinabove.

Figure 9:
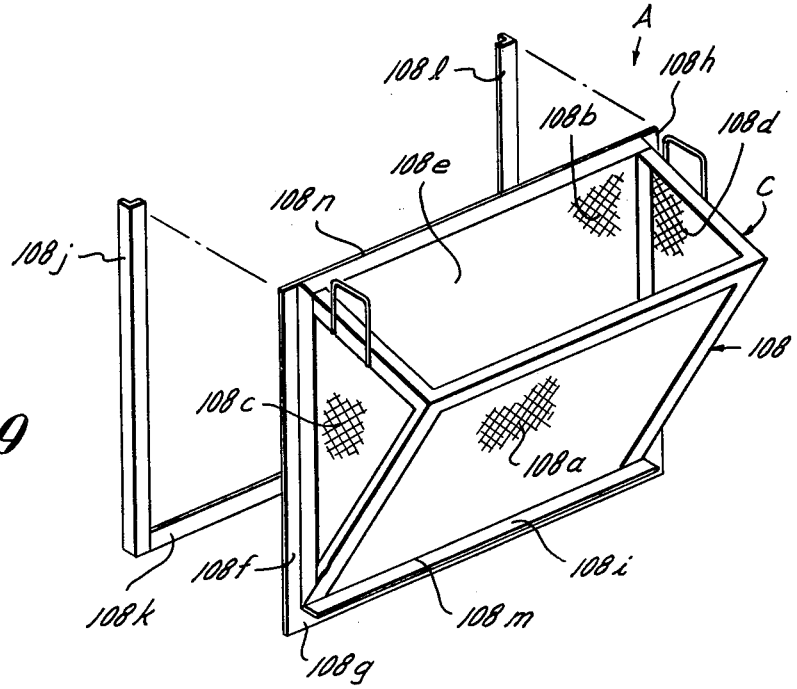
FIG. 9 is an isometric view of the sludge basket of the present invention as adapted to be mounted within the cleaning fluid tank; and, FIG. 10 is a diagram detailing schematically the various fluid systems utilized for and during the cleaning operation of the washing apparatus of the present invention.

The washing apparatus A of the present invention further includes collection means C with the cleaning fluid tank T for collecting the sludge formed in the washing of the tubular member M. The collection means C includes a plurality of sludge baskets 108, as best seen in FIG. 9, that are removably mounted with the cleaning fluid tank T for collecting sludge therein. Preferably, each of the sludge baskets is formed having a front portion 108*a*, a back portion 108*b*, side portions 108*c*, 108*d* and a general rectangularly-shaped top portion 108*e*. Preferably, the back portion 108*b* is formed having a suitable mounting lip 108*f* positioned vertically along the left side of the sludge basket 108 as viewed in FIG. 9; a mounting lip 108*g* positioned along the lowermost portion of the sludge basket 108; and a mounting lip 108*h* positioned along the right hand side portion of the sludge basket 108. A basket support lip 108*i* is formed with the sludge basket 108 preferably with the mounting lip 108*g* and extends along the lowermost portion of the back portion 108*b*. The mounting lips 108*f*, 108*g*, 108*h* are adapted to be received in mounting lip receptacles 108*j*, 108*k*, and 108*l*, respectively, with the mounting lip receptacles adapted to be mounted on the interior surface of the cleaning fluid tank T as best shown in FIGS. 6 and 7. As such, the sludge baskets 108 are adapted to be positioned within the mounting lip receptacles 108*j*, 108*k*, 108*l* by a vertical lowering of the mounting lips 108*f*, 108*g*, 108*h* thereinto compatibly formed respective mounting lip receptacles 108*j*, 108*k*, 108*l* for proper positioning of the sludge baskets 108 with respect to the cleaning fluid tank T. Preferably, the front portion 108*a* and back portion 108*b* adjoin each other adjacent the lower end surface 108*m* of the back portion 108*b* at an acute angle. Furthermore, preferably the back portion 108*b* and top portion 108*e* adjoin each other adjacent an upper end surface 108*n* of the back portion 108*b* at an acute angle thus resulting in the top portion 108*e* and front portion 108*a* adjoining each other at an obtuse angle. It will be appreciated that the front, back and two side portions 108*a*, 108*b*, 108*c*, 108*d* are formed primarily of a screen mesh and useful in filtering sludge from the cleaning fluid 10. Consequently, the top portion 108*e* of sludge basket 108 is open for receiving cleaning fluid flow therethrough and any and all sludge may be captured within the interior portions of the sludge basket 108. It will be appreciated that placement of the sludge baskets 108 are such that they are positioned slightly below the fluid level 110 (FIGS. 6, 7) of the cleaning fluid 10 within the cleaning fluid tank T. With the top portion 108*e* being open, such is at an acute angle with respect to the adjacent walls of the fluid tank 12. This slight acute angle of the top portion 108*e* with respect to the walls of the tank 12 encourages the flow of the cleaning, fluid 10 having sludge entrained therewith, thereinto the sludge baskets 108 for filtering the large quantities of sludge removed from the soiled tubular member M during cleaning operations accomplished with the washing apparatus A of the present invention. As best seen in FIG. 4, it is preferred that the sludge baskets 108 be positioned along the interior wall surface 12*f* of side wall 12*b*, and in the preferred form, a plurality, of such sludge baskets 108 are suitably mounted therewith.

Figure 2:
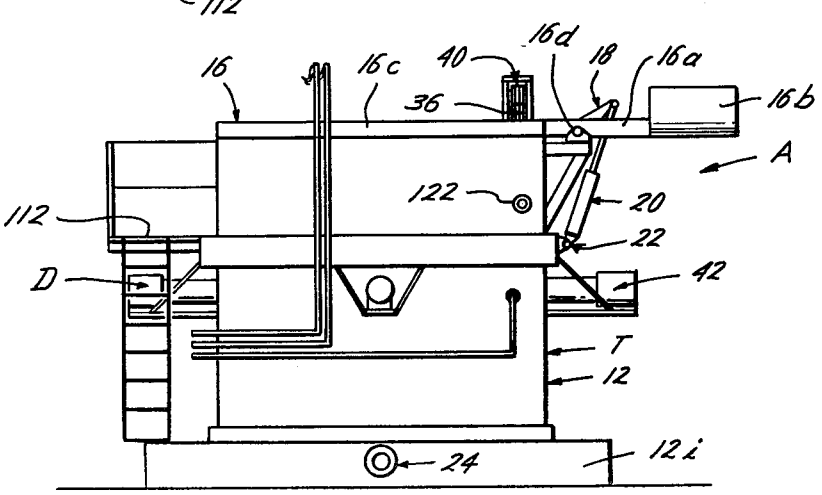
FIG. 2 is an elevational, end view of the washing apparatus of the present invention, taken along the lines 2—2 of FIG. 1.

As shown in FIGS. 1 and 2, a suitable platform support 112 is mounted adjacent the exterior of the cleaning fluid tank T to provide a suitable support for maintenance personnel working in the vicinity of the washing apparatus A of the present invention. Ladder 112*a* provides ease of access to the platform support 112. Upon opening of the tank closure 16, maintenance personnel standing upon the platform support 112 may remove the sludge baskets 108 from the interior wall surface 12*f* of side wall 12*b* of tank 12 to remove accumulations of sludge having collected therein. It should be noted that there is no requirement that the cleaning fluid tank T be drained of cleaning fluid 10 in order to accomplish such sludge removal operations; but to the contrary, such may be accomplished while the washing apparatus A of the present invention is utilized in cleaning the soiled tubular member M.

As noted hereinabove, such ease of removal of the sludge baskets 108 is accomplished by means of the mounting lip receptacles corresponding to the mounting lips formed with each individual sludge basket 108 such that the mounting lip receptacles removably receive each of the mounting lips of each respective sludge basket 108 for removably mounting the sludge basket 108 with the cleaning fluid tank T. Furthermore, the positioning of the sludge baskets 108 enhances removal of sludge from the cleaning fluid 10 because of particular placement thereof with respect to the agitation means 42 which, in its agitation of the cleaning fluid 10 for cleaning the soiled tubular member M, directs the cleaning fluid against the tubular member M for the removal of soil therefrom, with the entrained soil and cleaning fluid, hence sludge, thereafter being directed thereinto the sludge baskets 108 for filtration thereof. As will be appreciated, the open top portion 108*e* promotes circulation of cleaning fluid 10 thereinto the sludge basket 108, permitting collection of sludge therein yet allowing cleaning fluid 10 to escape through the front portion 108*a* and side portions 108*c*, 108*d*, as well as to some extent through back portion 108*e*.

The washing apparatus A of the present invention further includes heating means 114 disposed within the cleaning fluid chamber 14 of the cleaning fluid tank T for heating the cleaning fluid 10 therein. The heating means 114 may include suitable heating coils 114*a* adapted to receive a suitable heating fluid flowing in the direction of arrow 116, with such flowing through heating coils 114*a* and exiting therefrom in the direction of arrow 118. The heating fluid may include steam and/or any other suitable heat carrying medium capable of appropriately heating the cleaning fluid 10 within the cleaning fluid tank T.

As best seen in FIGS. 3 and 4, the washing apparatus A of the present invention further includes a suitable gutter 120 extending between sidewalls 12*a*, 12*b* adjacent end wall 12*d*, with the gutter 120 in flow communication with gutter drain 122, for withdrawing excess amounts of cleaning fluid 10 that may accumulate within the cleaning fluid tank T to prevent overflowing thereof.

As best seen in FIG. 10, the cleaning fluid and hydraulic network is controlled by control panel assembly 124 which permits regulation of the system networks of the washing apparatus A of the present invention. The control panel assembly 124 includes preferably a control panel 124*a*, starter rack 124*b* and starter 124*c* as utilized in operations of the washing apparatus A of the present invention. The hydraulic network is designated generally by the dotted lines 125 and includes a fluid reservoir 126 which is adapted to be in the flow communication with flow line 128. The flow line 128 communicates with fluid pump 130 driven by motor means 130*a* for pressurizing the hydraulic network 125, with the discharge thereof being directed through flow line 132. The fluid flow is thereafter directed through flow line 134, 136 into valves 138, 140, 142, 144, which preferably are solenoid actuated. Upon activation of valve 138, the tank closure 16 is appropriately raised and/or lowered by means of the actuation of hydraulic power means 20, as is desired. Actuation of valve 140 results in powered rotation of the power rollers 32 by activation of motor means 32*d*. On the other hand, activation of valve 142 results in movement of the carriage means 48 along the carriage track 52 by means of suitable urging upon the carriage means 48 by means of take-up reel 146. Limit switches 148, 150 limit the extent with which the carriage means 48 may travel along the carriage track 52. Activation of valve 144 results in powered movement of the hydraulic power means 38 for raising and lowering of the frame member 26 as described hereinabove. Suitable check valves 152, 154 help to protect the integrity of the hydraulic circuitry. Returned hydraulic fluid flows through flow line 156, therethrough suitable filter 158 and heat exchanger 160 to thereafter be returned through flow line 162 into fluid reservoir 126 for storage. Furthermore, auxiliary flow lines 164, 166, 168 and 170 return hydraulic fluid to the fluid reservoir 126 when necessary and as required by valves 140, 142, and fluid pump 130, respectively.

The sludge drain outlet 24 is in fluid communication with valve 172 (FIG. 10) which regulates the withdrawal of sludge from the bottom of the cleaning fluid tank T and directs the same outwardly through the flow line 174 to be appropriately discharged as is desired. Furthermore, the sludge basket 108 is shown schematically in FIG. 10 as being removable from the cleaning fluid tank T, with such being removable from its mounted position shown in dotted lines as position 174.

In the use or operation of the washing apparatus A of the present invention, a tubular member M is placed in proximity of the washing apparatus A. Thereafter, the hydraulic power means 20 is actuated to raise the tank closure 16 to the open position of FIG. 7. Thereafter, the frame member 26 of the support means S is moved to its uppermost position as shown in FIG. 7 and the soiled tubular member M is thereafter placed upon the roller means 28. Actuation of the hydraulic power means 38 results in the lowering of the frame member 26 having the tubular member M therewith thereinto the cleaning fluid chamber 14 within the cleaning fluid tank T. It will be appreciated that either prior to this procedure or after, that the cleaning fluid 10 may be appropriately heated by the heating means 114 to an appropriate temperature for enhanced cleaning and dissolving of soiled matter affixed to the tubular member M. After the tubular member M is suitably located within the cleaning fluid tank T, the hydraulic power means 20 is actuated resulting in the tank closure 16 sealing off the uppermost portion of the cleaning fluid tank T. It is preferred that the cleaning fluid 10 be brought to a level indicated by position 110 so that the tubular member M is substantially immersed in the cleaning fluid 10 while in the cleaning fluid tank T. Thereafter, the agitation means 42 of the directing means D is energized resulting in powered rotation of the propellors 42*a* to agitate the cleaning fluid 10 within the cleaning fluid tank T. Such agitation helps to remove soiled particles from the internal and external portions of the tubular member M. While the agitation means 42 is suitably agitating the cleaning fluid 10 within the cleaning fluid tank T, the power rollers 32 permit rotation of the tubular member M about its longitudinal axis to enhance the close positioning of the tubular member M into proximity with the agitation means 42 in order that the brunt of the propellor action upon the cleaning fluid 10 be experienced by the tubular member M for enhanced cleaning thereof. Furthermore, the tubular member M may be positioned in a stationary position while the carriage means 48 and nozzle means 50 therewith move along the carriage track 52 by activation of carriage drive means 54. The high pressure fluid exiting from the high pressure nozzle 58 of the nozzle means 50 blasts away the soil particles affixed to the outer surface of the tubular member M. It will be appreciated that the carriage means 48 having a nozzle means 50 therewith is adapted to traverse the entire length of the tubular member M whereinafter the tubular member M may be rotated a desired number of degrees about its longitudinal axis for repositioning purposes whereinafter the carriage means 48 and nozzle means 50 therewith may again make a longitudinal track along the length thereof to remove the soil particles affixed to the outer surface of the tubular member M.

During the course of such cleaning operations with the washing apparatus A of the present invention, soil particles become entrained with the cleaning fluid 10 and form sludge, which is collected within the sludge baskets 108. Merely by stopping the directing means D including agitation means 42 and actuation of the hydraulic means 20 to raise top closure 16 permits an operator positioned upon platform 112 to reach into the cleaning fluid tank T for removal of the sludge baskets 108, permitting the removal of sludge from the sludge baskets 108 and quick replacement thereof to effectuate suitable sludge cleaning of the cleaning fluid 10. Thereafter, the tank closure 16 may be closed and cleaning operations again be commenced. The heating means 114 insures the maintenance of the proper temperature for the cleaning fluid 10 such that enhanced cleaning may be effectuated. Upon completion of cleaning operations, the tank closure 16 is thereafter opened by actuation of hydraulic power means 20 and the tubular member M raised by actuating hydraulic power means 38 which raises the frame member 26, thus raising the tubular member M from the cleaning fluid chamber 14 within the cleaning fluid tank T. Thereafter, the tubular member M may be removed from the roller means 28 and the operation thereafter repeated with another soiled tubular member M.

Thus, the washing apparatus A of the present invention provides a new and improved washing apparatus and method for cleaning soiled tubular members M which comprehends utilization of a support means S for raising and lowering of the tubular member M to and from the cleaning fluid tank T, and having suitable directing means D for directing cleaning fluid against the tubular member M for enhanced cleaning action thereof, and further comprehending the inclusion of collection means C for collecting sludge that is removed from the soiled tubular member M during cleaning operations thereof.

The foregoing disclosure and description of the invention are illustrative and explanatory thereof, and various changes in the size, shape and materials as well as in the details of the illustrated construction may be made without departing from the spirit of the invention.

I claim:

1. A washing apparatus for washing a soiled tubular member in a cleaning fluid, the cleaning fluid and soil forming sludge within the washing apparatus, comprising:

a cleaning fluid tank for containing cleaning fluid therein;

support means with said cleaning fluid tank for supporting the tubular member between a first position wherein the tubular member is not within said cleaning fluid tank and a second position wherein the tubular member is disposed substantially within the cleaning fluid in said cleaning fluid tank, said support means including a frame member for receiving the tubular member for movement thereof between said first and second positions;

moving means with said cleaning fluid tank and said frame member for moving said frame member and the tubular member between said first and second positions;

directing means with said cleaning fluid tank for directing cleaning fluid against the soiled tubular member when the tubular member is in said second position for washing the same; and, collection means with said cleaning fluid tank for collecting the sludge formed during washing of the tubular member.

2. The washing apparatus of claim 1 wherein said support means further includes:

roller means with said frame member for permitting rotation of the tubular member when supported by said frame member.

3. The washing apparatus of claim 2, wherein said roller means includes:

power rollers mounted with said frame member, said power rollers having an axis of rotation that is adapted to be substantially parallel to the longitudinal axis of the tubular member for powered rotation of the tubular member.

4. The washing apparatus of claim 3, wherein said roller means includes:

idler rollers mounted with said frame member, said idler rollers having an axis of rotation that is adapted to be substantially parallel to the axis of rotation of said power rollers and the tubular member.

5. The washing apparatus of claim 1, wherein said moving means includes:

hydraulic power means with said cleaning fluid tank for providing hydraulic motive power; and, pulley means with said frame member and operatively connected with said hydraulic power means for moving the tubular member between said first and second positions.

6. The washing apparatus of claim 7, wherein said high pressure fluid means includes:

carriage means mounted for movement along the length of said cleaning fluid tank; and, nozzle means mounted with said carriage means for receiving high pressure cleaning fluid to be directed against the tubular member for washing thereof.

7. The washing apparatus of claim 6, further including:

a carriage track mounted with said cleaning fluid tank, said carriage track having a longitudinal axis substantially parallel to the longitudinal axis of the tubular member when in said second position, said carriage track adapted to receive said carriage means for movement thereon.

8. The washing apparatus of claim 6, further including:

carriage drive means for moving said carriage means along said fluid cleaning tank as desired.

9. The washing apparatus of claim 6, further including:

high pressure fluid means in communication with said nozzle means for providing high pressure cleaning fluid for said nozzle means.

10. The washing apparatus of claim 1, wherein said collection means includes:

a plurality sludge baskets removably mounted with said cleaning fluid tank for collecting sludge therein;

each of said sludge baskets is formed having a front portion, a back portion, two side portions and a top portion;

said front and back portions adjoining each other adjacent a lower end surface of said back portion at an acute angle;

said back and top portions adjoin each other adjacent an upper end surface of said back portion at an acute angle; and, said top and front portions adjoining each other at an obtuse angle.

11. The washing apparatus of claim 1, wherein:

said collection means includes a plurality of sludge baskets for collecting sludge therein, each of said sludge baskets is formed having a mounting lip that is adapted to be disposed adjacent said cleaning fluid tank; and, said cleaning fluid tank has a plurality of mounting lip receptacles corresponding to the number of said sludge baskets mounted in said cleaning fluid tank adjacent the surface of the cleaning fluid within said cleaning fluid tank, each of said mounting lip receptacles removably receiving each of said mounting lips of said sludge baskets, respectively, for removably mounting said sludge baskets with said cleaning fluid tank.

12. The washing apparatus of claim 1, further including:

a tank closure pivotally mounted with said cleaning fluid tank for covering the same, said tank closure having counterweight means for counteracting the weight of said tank closure to facilitate ease of opening and closing of said tank closure.

13. The washing apparatus of claim 1, further including:

heating means disposed within said cleaning fluid tank for heating the cleaning fluid therein.

14. A washing apparatus for washing a soiled tubular member in a cleaning fluid, the cleaning fluid and soil forming sludge within the washing apparatus, comprising:

a cleaning fluid tank for containing cleaning fluid therein;

support means with said cleaning fluid tank for supporting the tubular member between a first position wherein the tubular member is not within said cleaning fluid tank and a second position wherein the tubular member is disposed substantially within the cleaning fluid in said cleaning fluid tank;

directing means with said cleaning fluid tank for directing cleaning fluid against the soiled tubular member when the tubular member is in said second position for washing the same;

said directing means including agitation means and high pressure fluid means, said agitation means mounted with said cleaning fluid tank for agitating the cleaning fluid in said cleaning fluid tank when the tubular member is in said second position, to enhance washing of the tubular member;

said agitation means including a plurality of propellors mounted with said cleaning fluid tank about a portion of the inside perimeter thereof and adapted to be immersed in the cleaning fluid contained by said cleaning fluid tank for agitating the cleaning fluid;

said high pressure fluid means with said cleaning fluid tank for flowing high pressure cleaning fluid against the soiled tubular member, for enhanced washing thereof; and, collection means with said cleaning fluid tank for collecting the sludge formed during washing of the tubular member.

15. A washing apparatus for washing a soiled tubular member in a cleaning fluid, the cleaning fluid and soil forming sludge within the washing apparatus, comprising:

a cleaning fluid tank for containing cleaning fluid therein;

support means with said cleaning fluid tank for supporting the tubular member between a first position wherein the tubular member is not within said cleaning fluid tank and a second position wherein the tubular member is disposed substantially within the cleaning fluid in said cleaning fluid tank;

directing means with said cleaning fluid tank for directing cleaning fluid against the soiled tubular member when the tubular member is in said second position for washing the same, said directing means including high pressure fluid means with said cleaning fluid tank for flowing high pressure cleaning fluid against the soiled tubular member, for enhanced washing thereof; and, collection means with said cleaning fluid tank for collecting the sludge formed during washing of the tubular member.

16. A washing apparatus for washing a soiled tubular member in a cleaning fluid, the cleaning fluid and soil forming sludge within the washing apparatus, comprising:

a cleaning fluid tank for containing cleaning fluid therein;

support means with said cleaning fluid tank for supporting the tubular member between a first position wherein the tubular member is not within said cleaning fluid tank and a second position wherein the tubular member is disposed substantially within the cleaning fluid in said cleaning fluid tank;

directing means with said cleaning fluid tank for directing cleaning fluid against the soiled tubular member when the tubular member is in said second position for washing the same;

collection means with said cleaning fluid tank for collecting the sludge formed during washing of the tubular member;

said collection means including a plurality of sludge baskets for collecting sludge therein, each of said sludge baskets is formed having a mounting lip that is adapted to be disposed adjacent said cleaning fluid tank; and, said cleaning fluid tank has a plurality of mounting lip receptacles corresponding to the number of said sludge baskets mounted in said cleaning fluid tank adjacent the surface of the cleaning fluid within said cleaning fluid tank, each of said mounting lip receptacles removably receiving each of said mounting lips of said sludge baskets, respectively, for removably mounting said sludge baskets with said cleaning fluid tank.

17. The washing apparatus of claim 14, wherein said agitation means is hydraulically actuated.

18. The washing apparatus of claim 15 wherein:

said tank closure is hydraulically actuated for opening and closing thereof.

* * * * *